United States Patent [19]

Morrison

[11] 4,349,295

[45] * Sep. 14, 1982

[54] STRUCTURAL RIDGE MEMBER FOR VIBRATING CONCRETE SCREEDS

[76] Inventor: Donald R. Morrison, 6228 Eagle Peak Dr., Charlotte, N.C. 28214

[ * ] Notice: The portion of the term of this patent subsequent to Apr. 14, 1998, has been disclaimed.

[21] Appl. No.: 251,115

[22] Filed: Apr. 6, 1981

Related U.S. Application Data

[62] Division of Ser. No. 132,623, Mar. 21, 1980, Pat. No. 4,261,694.

[51] Int. Cl.[3] ..... E01C 19/40

[52] U.S. Cl. ..... 404/114; 404/119

[58] Field of Search ..... 404/114, 118, 119, 96, 404/97, 101; 425/456, 218

[56] References Cited

U.S. PATENT DOCUMENTS

| | | | |
|---|---|---|---|
| 2,094,910 | 10/1937 | Baily | 404/114 X |
| 2,890,632 | 6/1959 | Madison | 404/96 |
| 3,164,072 | 1/1965 | Blankenship | 404/96 |
| 3,435,740 | 4/1969 | McGall | 404/119 X |
| 4,030,873 | 6/1977 | Morrison | 404/119 X |
| 4,213,749 | 7/1980 | Morrison | 404/119 X |
| 4,249,327 | 2/1981 | Allen | 404/114 |
| 4,253,778 | 3/1981 | Morrison | 404/114 |
| 4,261,694 | 4/1981 | Morrison | 404/119 X |

*Primary Examiner*—Nile C. Byers, Jr.
*Attorney, Agent, or Firm*—B. B. Olive

[57] ABSTRACT

An improved frame construction for a portable, vibrating-type concrete screed incorporates a specially designed hollow ridge tube extending along the apex of an elongated open frame of triangular cross section and providing means for adjusting relative angular positions of adjoining screed units and for passage of air when the screed is air operated.

1 Claim, 4 Drawing Figures

STRUCTURAL RIDGE MEMBER FOR VIBRATING CONCRETE SCREEDS

CROSS-REFERENCE TO RELATION APPLICATION

This application is a division of pending application Ser. No. 132,623, filed Mar. 21, 1980, entitled "AIR VIBRATED/WINCHED CONCRETE SCREED", now U.S. Pat. No. 4,261,694.

TECHNICAL FIELD

This invention relates to lightweight, portable, vibrating, concrete screeds and more specifically to the frame constructions employed in such screeds.

BACKGROUND ART

Lightweight, portable, vibrating, concrete screeds of the type to which the present invention is generally related are described in applicant's prior U.S. Pat. Nos. 4,030,873, 4,213,749 and 4,253,778. The general state of the art is believed to be fully set forth in these references and therefore will not be restated except for pointing out certain prior art practices which primarily relate to the screed frame construction.

The present invention is primarily directed to the frame construction employed in vibrating screeds of the type described in applicant's prior patents. The improved frame construction of the invention is illustrated as embodied in an air-powered, vibrating, concrete screed.

As one aspect of the type of construction used in portable vibrating concrete screeds of the type to which the invention relates, it may be noted that the typical screed frame is made up of components which are welded together. Due to the stringent operating requirements and heavy wear encountered on the job, it is not uncommon for frame members to be bent or damaged and thus require replacement. An all-welded construction, of course, makes replacement of an individual frame component both time consuming and expensive.

Since the typical portable, concrete screed of the type to which the invention relates has a triangular cross section, it has become the practice to use a piece of ordinary steel pipe running lengthwise of the frame at the apex of the triangle and the frame braces are welded to this pipe. This pipe has also been used in air-vibrated concrete screeds as a conduit for carrying pressurized air and air vibrator hoses have been connected to the pipe as a means for supplying air to the vibrators. While the use of a pipe member of this type as both a structural member and as an air conduit is advantageous, a simple round pipe of this kind does not lend itself readily to the type of screed frame in which the members are bolted together for ease of replacement when damaged. Thus, there is a need for an improved screed frame adapted to be bolted together and employing an improved apex tube construction that both lends itself to serving as an air conduit as well as a structural member which can be easily bolted to other structural members for establishing a relatively rigid screed frame.

As a further aspect of screed constructions, it has been known to provide means enabling one screed section to be angled relative to another screed section to adjust to concrete pouring operations where a crown or valley shape is formed with the screed. However, it has not been known so far as applicant is aware to provide a screed frame construction in which a tubular member located at the apex of the triangular-shaped frame and adapted to serve as an air conduit and as a bolt securing structural member is also adapted to be used as a means for adjusting one screed section relative to another.

The object of the present invention thus becomes that of providing an improved frame construction for a vibrating-type concrete screed aimed at overcoming the shortcomings of prior screed frame constructions as discussed above and is illustrated embodied in an air-powered screed. Other objects will become apparent as the description proceeds.

DISCLOSURE OF THE INVENTION

The invention provides an improved frame for a portable, lightweight, vibrating, concrete screed having an elongated frame of triangular cross section. The screed frame is adapted to be bolted together to facilitate replacement of damaged parts and incorporates a tubular structural member of special design which runs lengthwise of the frame at the apex. Through special fittings connected to this tubular structural member, provision is made for adjusting the angle of one screed section relative to the other to accommodate to crown and valley screeding requirements. Air-powdered vibrators and air-powdered winching apparatus are also illustrated as being mounted on the screed and powered by air supplied through the mentioned tubular structural member.

BEST MODE FOR CARRYING OUT THE INVENTION

Figure 1:
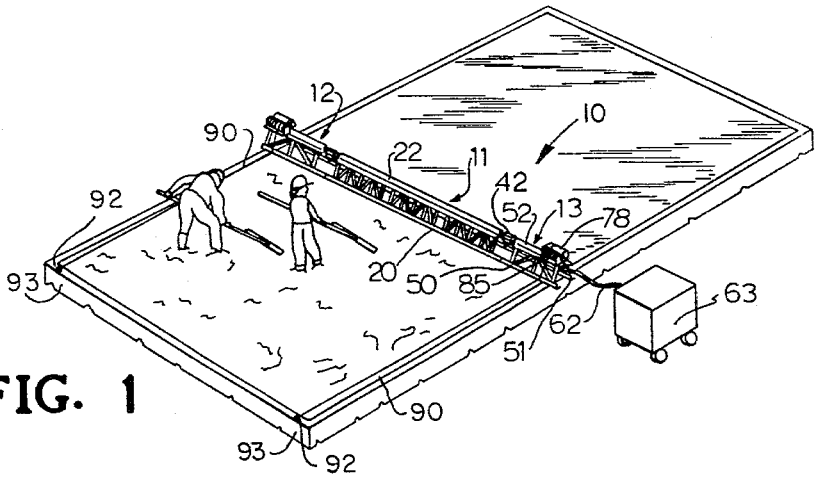
FIG. 1 is an isometric view of an air-powered, vibrating, concrete screed incorporating the improved frame of the invention and shown in use in a typical concrete pouring and finishing operation.

As illustrated in FIG. 1, a screed 10 is illustrated as being formed of a base frame unit 11 and a pair of detachable frame units 12 and 13, each of which units incorporates the improved frame construction of the present invention. Units 12, 13 provide winching mechanisms.

In a preferred form, the base frame unit 11 as well as the winching frame units 12 and 13 are made up of components adapted to be bolted together and are illustrated as such. Base frame unit 11 and winching frame units 12, 13 can be of various lengths according to job requirements and can be easily and quickly connected together as later described so as to provide different lengths of screed for spanning forms of different widths. The base frame unit 11, by way of example, is assumed to be illustrated as being ten feet in length and the winching frame unit 12, 13 are each assumed to be illustrated, by way of example, as being 2½ feet in length.

Referring first to a typical base frame unit 11, base unit 11 is preferably in the form of an isosceles triangle with screed plates 20, 21 forming the lower corners of the triangle. A specially-designed, extruded, hollow ridge tube 22 forms the apex of the triangle and constitutes a significant feature of the present invention. Ridge tube 22 extends throughout the length of base frame unit 11 and is connected to the screed plates 20, 21 by suitable cross braces 23 and vertical braces 24. The hollow structural ridge tube 22 includes a tube portion **22*a* having a bore 26 extending the length thereof and also includes appended, outwardly and downwardly extending flanges 22*b*, 22*c*. Flanges 22*b*, 22*c* are provided with holes 27 and are designed to overlap the upper ends of braces 23, 24 to receive nut and bolt arrangements 28. Braces 23, 24 are also connected to plates 20, 21 by other nut and bolt arrangements 25** as illustrated in the drawings. As previously mentioned, nut and bolt connections are preferred for use of replacement of brace members in the event of breakage or damage.

Figure 4:
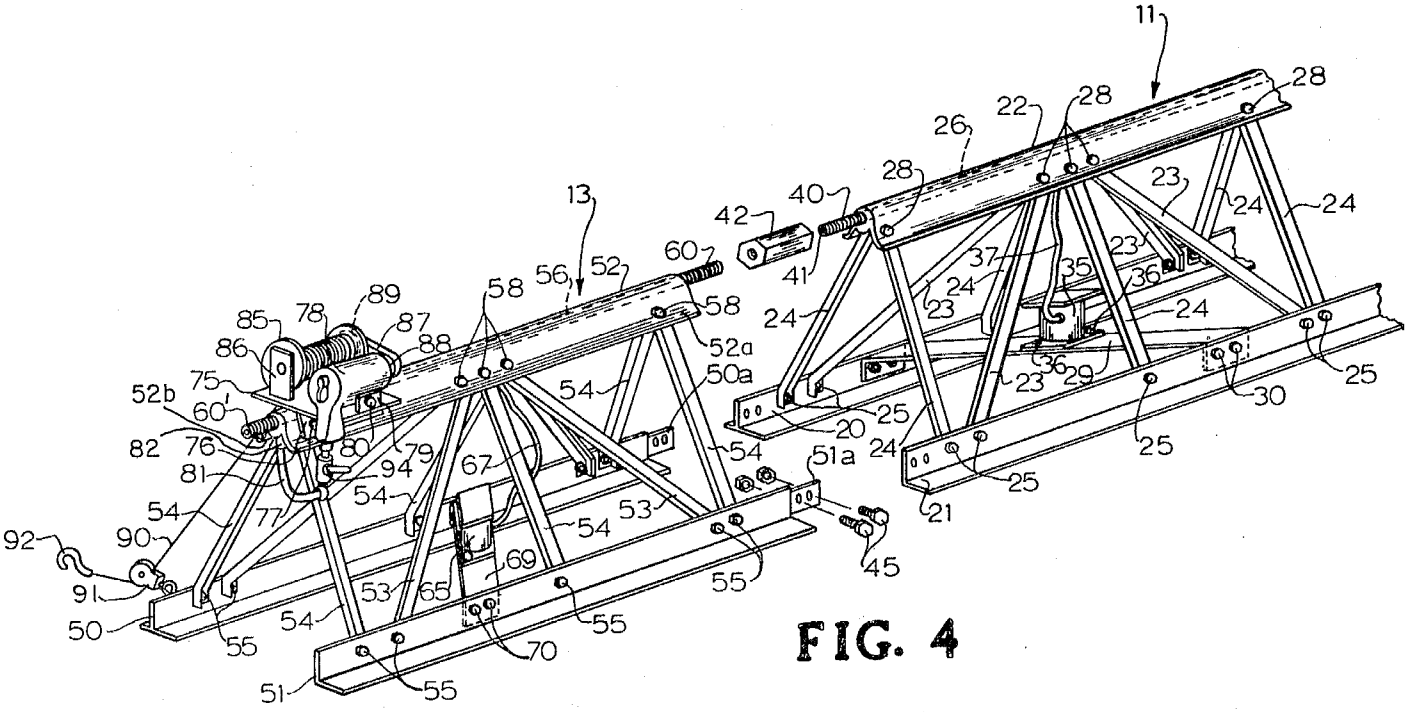
FIG. 4 is an enlarged, fragmentary, perspective view of a winching frame unit and a portion of a base frame unit incorporating the improved frame construction of the invention.

The present invention as previously mentioned primarily relates to an improved frame construction for a vibrating-type concrete screed and is described in reference to an air-powered vibrating concrete screed having air vibrators. For this purpose, angularly disposed transverse braces 29 extend between leading screed plate 20 and trailing screed plate 21 and are bolted thereto by nut and bolt arrangements 30. Braces 29 are preferably disposed at an angle of approximately 45° relative to the longitudinal axis of screed plate 21 as indicated in FIG. 4 although a range of from 15° to 45°, e.g., is considered to be within desirable limits. Each transverse brace 29 mounts an air-powered vibrator 35 thereon so that each vibrator 35 is located at the midpoint of a brace 29. Vibrators of a type suited to this application of the improved frame construction of the invention are commercially available from National Air Vibrator Company, 6830 Wynnwood Lane, Houston, Tex. 77008, and are designated as Model No. BH-1. Vibrators 35 are bolted to braces 29 by nut and bolt arrangements 36 midway of the length of each brace and are thus aligned along a central longitudinal axis between the leading and trailing screed plates 20, 21.

The specially-designed tube 22 embodied in the improved frame of the invention enables air to be supplied to vibrators 35 through flexible supply lines 37 having fittings 38 on the free ends thereof and adapted for snap-fit connection with the fittings 39 screwed into tube 22 and communicating with the tube bore 26 at appropriate locations. The number of fittings 39 mounted in tube bore 26 will, of course, be determined by the number of vibrators 35 which are employed.

Figure 3:
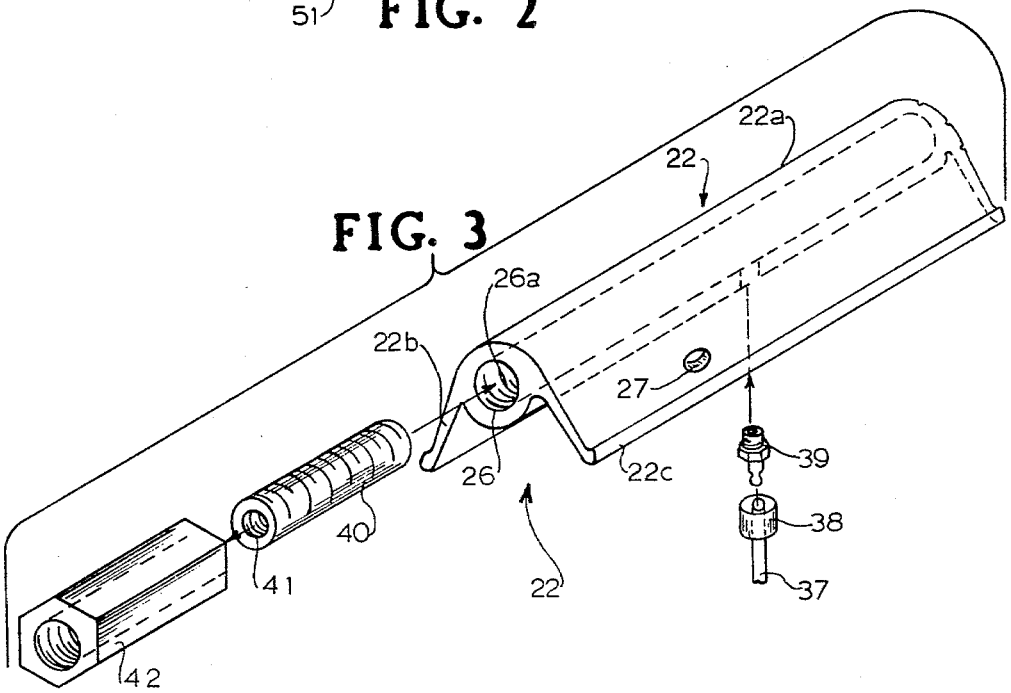
FIG. 3 is an enlarged, perspective view of a section of a tubular frame member forming part of the improved frame of the invention and through which air may be forced for operating vibrators and winching units and with illustrated fittings for connecting the air vibrators and for connecting one such tubular member to another.

Provision is made for communicating the air supply between screed units by providing the outermost ends of each tube bore 26 with internal threads **26*a* adapted to receive an externally-threaded hollow stud member 40 as best illustrated in FIGS. 3 and 4. Stud member 40 has a bore 41 extending its length and receives on its free end an internally-threaded hollow turnbuckle 42 through which air is also adapted to pass. Air can thus be supplied to vibrators 35 on base frame unit 11 by passing through turnbuckle 42, stud member 40, tube bore 26, air fittings 39 and supply lines 37. The turnbuckles 42 at each end of the base frame unit 11 are in turn adapted to be connected to the winching frame units 12, 13** as next described.

Since the winching frame units 12, 13 are identical, a description of frame unit 13 will be given by way of example in reference to FIG. 4. Frame unit 13 incorporates the improved frame construction of the invention and includes a pair of screed plates 50, 51 which align with plates 20, 21 on base frame unit 11 and extensions **50*a*, 51*a* extend outwardly for connection to plates 20, 21 by means of bolt and nut arrangements 45 which tie the base portions of units 11 and 13 together. An extruded hollow ridge tube 52 on frame unit 13 corresponds to ridge tube 22 on base frame unit 11 and aligned therewith a pair of externally-threaded hollow stud members 60, 60′ are threadadly received at the opposite ends of tube bore 56 in ridge tube 52. The stud member 60 nearest turnbuckle 42 threadably receives turnbuckle 42 and is oppositely threaded from stud member 40. Thus, turnbuckle 42 can serve both as a means of communicating stud member 40 with stud member 60 and can also serve as a means for pivoting frame unit 13 with respect to frame unit 11 by tightening or loosening turnbuckle 42 to accommodate for level screeding or forming of a crown or valley effect. Of course, two or more frame units like base frame unit 11 can be interconnected in the same manner and the same level, valley or crown type of screeding can be effected over relatively wide spans by adjusting turnbuckles 42 and bolts 45**.

Figure 2:
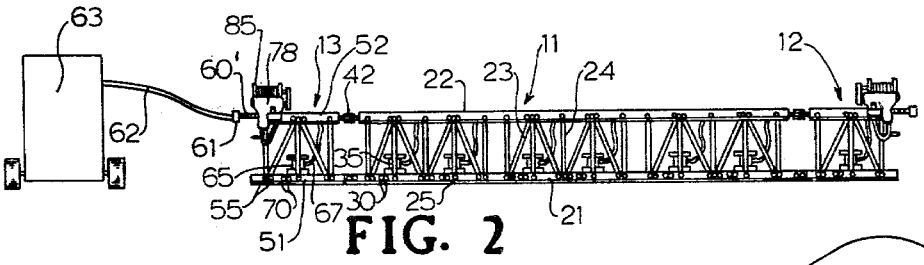
FIG. 2 is an enlarged, rear, elevation view of the screed apparatus of FIG. 1.

To continue the description concerned with distributing the air, it will be noted that the stud member 60′ on the outer end of winching frame unit 13 receives a fitting 61 for connecting supply line 62 to air source 63 as best seen in FIG. 2. The same general construction previously described in reference to base frame unit 11 is employed in winching frame unit 13. Thus, it will be noted that cross braces 53 and vertical braces 54 correspond to braces 23, 24 and connect plates 50, 51 to ridge tube 52 through nut and bolt arrangements 55, 58. A vibrator 65, corresponding to previously-mentioned vibrators 35, is mounted on an angularly disposed transverse brace 69 which is bolted to plates 50, 51 by other nut and bolt arrangements 70. Supply lines 67 from vibrator 65 connects to an air-fitting 68 (not shown) which is threadably received by ridge tube 52 and communicates with tube bore 56.

With continued reference to winching frame unit 13, it will be noted that support for an air-operated winching mechanism is provided by a platform plate 75 which is rigidly secured by welding to brackets 76. Brackets 76 are in turn secured to flanges **52*a*, 52*b* of unit 13 by bolt and nut arrangements which allow the winching unit to be located along the length of the screed wherever desired. In FIG. 4, platform 75 is shown secured to ridge tube 52 at its outermost end adjacent the air passage provided by the hollow stud member 60′. A reversible variable speed air motor 78, such as employed in an impact wrench, is rigidly secured to platform 75 by brackets 79 and bolts 80. Air is supplied to air motor 78 through line 81 which connects to a fitting 82 threaded into bore 56 of tube 52**.

A winching drum 85 is rotatably mounted on brackets 86 which are welded to platform 75. Drum 85 is driven by air motor 78 through chain 87 and sprockets 88, 89. A winching cable 90 is coiled on drum 85 and extends from drum 85 around pulley 91 and forward to a suitable anchoring structure 93 utilizing hook 92.

While the foregoing description has dealt primarily with describing the winching unit 13, it will, of course, be understood that the construction employed in winching unit 12 is identical to that employed in winching unit 13. Also, where a pair of winching units, i.e., winching units 12, 13, are employed there will be a pair of connecting cables 90 and a pair of anchoring structures 93 as depicted in FIG. 1. Each winching unit may, of course, be bolted to the appropriate ridge tube at any desired location in the manner previously described with reference to brackets 76 and the bolt and nut arrangements 77. Also, it should be noted that in some applications a single winching unit might be employed where a relatively narrow working span is involved. Utilizing a reversible air motor of the type previously mentioned also allows the cable to be retracted once the job has been completed. Furthermore, the speed of winching can be readily controlled by use of an appropriate air valve such as valve 94 shown connected to the air motor supply line 81.

In operation, pressurized air will be supplied to ridge tube 52 from air source 63. Part of the air supplied will be diverted to air motor 78 for the winching operation and other pressurized air will be directed to vibrators 65 and 35 through the interconnected hollow ridge tubes 52 and 22. As the respective vibrators 65, 35 operate, the vibrations produced will be transmitted through the respective braces 69, 29 to the respective leading and trailing interconnected plates 50, 51 and 20, 21.

The improved frame of the invention incorporating the specially-designed, internally-threaded, extruded hollow ridge tubes 22, 52 thus provides a means for enabling the base frame unit 11 and winching frame units 12, 13 to be connected together and adjusted in angular relation for level, valley, or crown-type screeding. The unique hollow ridge tube of the improved frame of the invention also provides an air conduit passage and with the downwardly and outwardly flared integral flange portions provide a practical means for joining the members making up the described bolted together type frame and for supporting the anchoring mechanism.

I claim:

1. A structural ridge member for use in air-vibrated concrete screeds of the isosceles triangle shaped, separable frame unit type, said ridge member being molded as an integral replaceable one piece member comprising:

(a) a hollow strengthening ridge tube portion adapted for being horizontally positioned at the apex of an isosceles triangle shaped screed frame unit so as to extend with its bore for the length of such frame unit and being internally threaded adjacent each of its bore ends; and (b) integral with said ridge tube portion on opposite sides thereof downwardly and outwardly extending integral solid flange portions extending for the length of said ridge tube portion and having holes formed therein enabling other structural members of said frame unit to be detachably attached thereto.

* * * * *